United States Patent [19]

Perk

[11] Patent Number: 4,532,749

[45] Date of Patent: Aug. 6, 1985

[54] LOUVERED CEILING

[76] Inventor: William E. Perk, 3419 E. 65th St., Cleveland, Ohio 44127

[21] Appl. No.: 467,446

[22] Filed: Feb. 17, 1983

[51] Int. Cl.[3] ..... E04C 2/42

[52] U.S. Cl. ..... 52/668

[58] Field of Search ..... 52/664, 668, 626, 581, 52/342

[56] References Cited

U.S. PATENT DOCUMENTS

| | | | |
|---|---|---|---|
| 3,745,735 | 7/1973 | Casano | 52/668 X |
| 4,034,534 | 7/1977 | Taylor | 52/668 |
| 4,040,231 | 8/1977 | Laborde | 52/664 |
| 4,079,563 | 3/1978 | Ollinger et al. | 52/664 |

FOREIGN PATENT DOCUMENTS

| | | | |
|---|---|---|---|
| 987064 | 4/1976 | Canada | 52/668 |
| 2559077 | 7/1977 | Fed. Rep. of Germany | 52/664 |

*Primary Examiner*—Donald G. Kelly
*Assistant Examiner*—Naoko N. Slack
*Attorney, Agent, or Firm*—Woodling, Krost, Rust & Hochberg

[57] ABSTRACT

An improved louvered ceiling construction is disclosed in which louver channel members are suspended from runner channel members by means of outwardly bent tabs on the ends of the channel members. The tabs are inserted behind widened slots in the runner. The runner slots are overlapped entirely by the tabs and louver channel interior so that leakage of light is prevented.

9 Claims, 7 Drawing Figures

Fig. 1
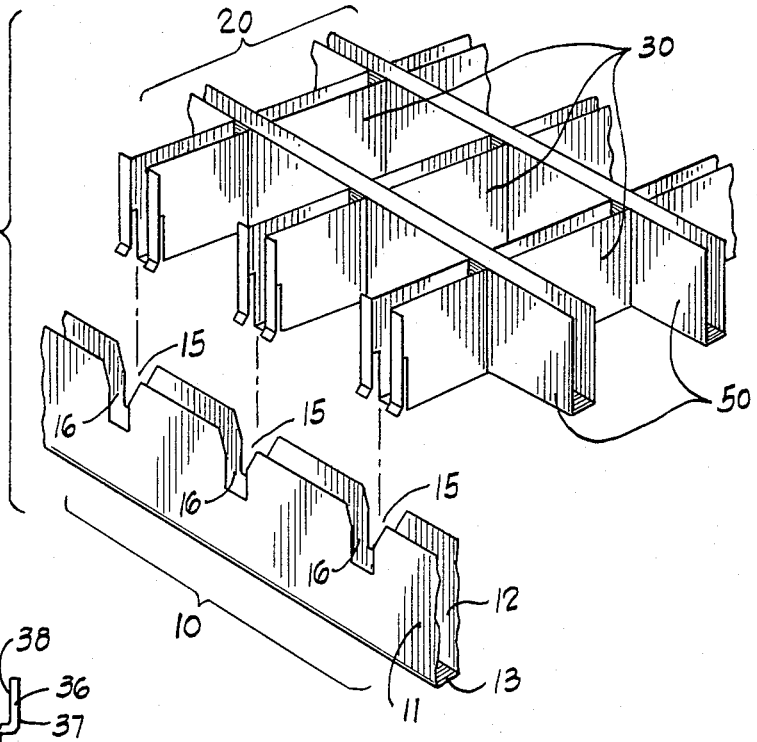
Fig. 3
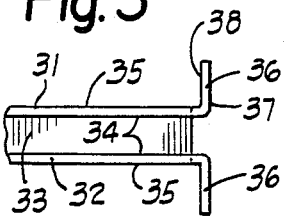
Fig. 7
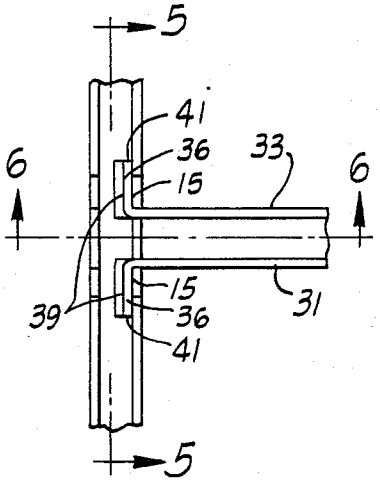
Fig. 4
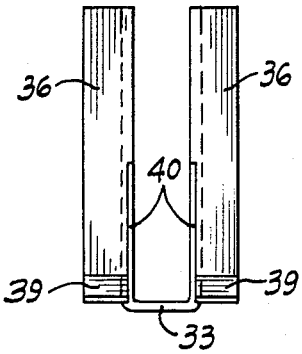
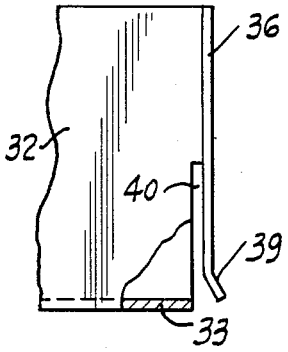
Fig. 2
Fig. 5
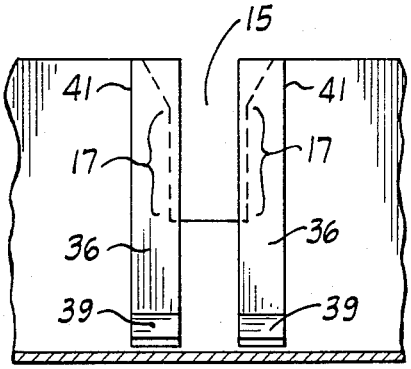
Fig. 6
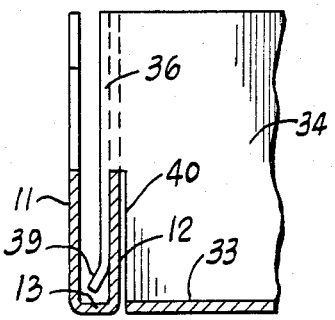

LOUVERED CEILING

BACKGROUND OF THE INVENTION

This invention relates to louvered ceilings, that is, false ceilings comprising louvers and supporting runners which are suspended below a normal ceiling, the louvers being panels of intersecting slat members (usually in an "egg-crate" construction) forming open cells therebetween, through which light may pass from light sources located between the louvered ceiling and the actual ceiling. More particularly, it relates to an improvement in the manner of suspending the louvers from their supporting runners.

In modern louvered ceilings, the louver slot members and runners are sometimes not solid material but are channel, that is, U-shaped in cross section with a base and two sidewalls. If the channel is used with its opening facing upward, it presents the appearance of a solid slat, but it is lighter in weight, easier to assemble, and more economical of materials.

Commonly, louvers may be supported on the runners by hooking on or hanging on to them. That is, the runner has holes or slots into which are inserted portions of the louver slat members. In one typical arrangement, the runner slots extend down from the top of the runner, and hooks or protrusions on the sides of the louver panel (that is, on the ends of the slat members), are simply dropped into the slots from above. In this case the slots may be tapered, that is, wider at the top, for easier assembly of the system.

A common problem with louvered ceilings is that when the louvers are assembled onto the runners, the joints or slots between the louver slat members and the runners leak light. This is an especial problem when the louver slat members are channel members, and more especially when the runner and louver material has a reflective metal surface, for then reflections both inside and outside the channel tend to emphasize the leaks.

One construction that has been proposed to solve the above problem is the ceiling described in U.S. Pat. No. 4,034,534 to Taylor. In that ceiling, the louvers and runners are made of channel section, and the louver channel members have hook-shaped extensions which drop into upwardly opening slots in the runners as described above. The light leak problem is solved by providing only one sidewall of each channel member with a hook-shaped extension, which drops into a narrow slot in the runner sidewall. The runner slot has a vertical edge meeting the outside face of this wall of the channel member. Thus that joint is light-tight even though the slot is tapered, for the gap at the top of the slot is located between the two walls of the channel member. The opposite wall of the slot member ends in a straight vertical edge which abuts the outside face of the wall of the runner. Thus that joint is also light-tight. Where louvers are to hang on both sides of a runner, the runner slots are not directly opposed, but are offset by a distance equal to the distance between the sidewalls of the channel members.

This construction suffers from a lack of robustness. For one thing, the individual channel-member-to-runner interlock depends upon the hooking of only one channel member sidewall into the runner slot. Since the intersecting louver channel members are joined with an interlocking "egg-crate" construction, looseness in the joints may permit the members to lose their mutual perpendicularity somewhat. Of more importance is the fact that the light-tightness of this system depends on the exact abutting of the outside face of one channel member sidewall to the vertical side of the runner slot, and also upon the exact abutting of the end of the other channel member sidewall to the outside face of the runner wall. Should any of the ends of the channel member sidewalls be bent during shipment or installation of the system, the esthetic integrity of the ceiling may be compromised.

SUMMARY OF THE INVENTION

The present invention provides a way of suspending the louvers from the runner which obviates the disadvantages set forth above. According to my invention, at least one, and preferably both sidewalls of each of the channel members hook into the runner by means of outwardly bent tabs on their ends, which are inserted into a single tapered slot in the runner sidewall. These tabs extend downward almost to the base wall of the runner so that a close sliding contact is made between part of each tab and the runner sidewall. The tabs are wide enough to more than cover whatever part of the slot opening extends outside of the portion of the runner sidewall which is covered by the interior of the channel member itself. In this construction, perpendicularity between the channel member and the runner provides for a light-tight joint, and it is designed for easy assembly. It is not necessary to manufacture or maintain the parts of my system to such close tolerances as in the Taylor device, and thus production economy is promoted.

It is an object of my invention to provide a ceiling structure which permits a light-tight installation of louver channels onto runner channels.

A further object of my invention is to provide such a ceiling structure which is easy to install.

A still further object of my invention is to provide such a ceiling structure which is sturdy and retains its strength and beauty even if not manufactured or maintained to close tolerances.

DESCRIPTION OF THE INVENTION AND DRAWINGS

That these objects and others have been attained can be seen from the following detailed description of a specific embodiment, and claims, taken in conjunction with the accompanying drawings, in which:

FIG. 1 is a perspective view of portions of a preferred embodiment of the runner and louver assembly of my invention;

FIG. 2 is a partial side elevation view of a channel member;

FIG. 3 is a plan view of the same channel member;

FIG. 4 is an end elevation view of the same channel member;

FIG. 5 is a cross-sectional view of a channel member and runner of my invention, as assembled, taken on the line 5—5 of FIG. 7;

FIG. 6 is a cross-sectional view of the same assembled channel member and runner, taken on the line 6—6 of FIG. 7; and FIG. 7 is a plan view of the same assembled structure.

FIG. 1 shows a runner 10 and a portion of a louver 20. The louver is made up of sets 30 and 50 of channel members, each of which is a length of U-shaped channel. Channel members 30 are mutually parallel, as are channel members 50; each channel member 30 is perpendicular to each channel member 50. Each two perpendicular members are joined by any of a number of means well known to those skilled in the art, for example, the egg-crate construction (perpendicular interlocking fit) of the Taylor device. The runner 10 is also a channel. It has a first sidewall 11 and a second sidewall 12 which are joined at the bottom by a runner base wall 13. As seen in FIGS. 2, 3, and 4, each channel member 30 has a third sidewall 31 and a fourth sidewall 32 joined at the bottom by a channel base wall 33. Each sidewall has an inner face 34 and outer face 35.

The runner 10 is provided with slots 15 which are widened at their tops, and are spaced the same distance apart as the distance between parallel channel members 30. The narrowest portion of each slot 15 is approximately as wide as the distance between the outer faces 35 of sidewalls 31 and 32, so that it closely but slidingly accommodates both sidewalls 31 and 32. Preferably, this narrowest width is maintained between opposed vertical portions 17 (as seen in FIG. 5) of the edges of slot 15, to provide the most stable fit of channel member 30 to runner 10, but the sides of slot 15 may have only a single narrowest point, usually at the bottom of slot 15.

The end of each third sidewall 31 and of each fourth sidewall 32 is bent away from the inside of the channel member 30, at about a 90 degree angle, into a tab 36 having an inner face 37 and an outer face 38. Each tab preferably has another upwardly bent portion 39 near its bottom to facilitate the insertion of the tabs into runner slot 15. At the line of each bend, as seen in FIG. 2, the third and fourth sidewalls are provided with a slot 40 extending from the channel base wall to a point between it and the top of the channel member. If it is desired that the runner base walls 13 and channel base walls 33 be on the same plane when the ceiling is assembled, the length of channel slot 40 will be the same as the distance from the bottom of runner slot 15 to the runner base wall 13.

As seen in FIGS. 5 and 7, the width of the tabs 36 is sufficient such that the distance between the ends 41 of the tabs on the third and fourth sidewalls is substantially greater than the width of the opening of slot 15 at any point. There is thus an overlapping of the outer face 38 of tabs 36 onto the inner face of the runner's second sidewall 12. Because of this, the leakage of light is prevented when the channel members 30 are affixed to the runners 10 by sliding tabs 36 into slots 15, as shown in FIGS. 5, 6 and 7. This construction is highly effective in minimizing light leakage even if there is slight variation in the tab width during manufacturing, or slight bending of the parts during shipment. It has the further advantage over the Taylor design that its slot and tab provide a self-centering feature so that even if the tabs are slightly bent, the joint may be easily and tightly assembled without having to straighten out the tabs.

As seen in FIG. 1, any runner 10 may also be provided with slots 16 in its first sidewall to receive a louver on the other side. Ordinarily a continuous grid appearance is desired, and therefore slots 15 and 16 will occur in directly opposed pairs as shown.

In an alternate embodiment, a tab 36 is provided on only the third sidewall 31 of each channel member 30. The fourth sidewall 32 is simply cut off in a vertical line, as in the Taylor device, and abuts the face of the second sidewall 12. In that case, the slot 15 must, of course, be made narrow enough at the top so that it does not extend outside of the line of abutment of the fourth sidewall 35 on the runner sidewall, and it must be narrowed at some point, usually the bottom, to a width which closely accommodates only the third sidewall 31 instead of both sidewalls 31 and 32. In this way, lateral movement of the third sidewall 31 in the slot 15 is prevented.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. In a louvered ceiling having at least one runner of upwardly open first channel section, comprising a first sidewall, a second sidewall and a first base wall joining said sidewalls, and having a louver adapted to be supported on said runner and comprising at least one upwardly open channel member having a third sidewall, a fourth sidewall and a second base wall joining said sidewalls, the improved assembly comprising a substantially planar tab or tabs joined to the end of at least one of said sidewalls of said channel member along an upper length thereof, said length extending downwardly from the top of said end to a point above the bottom of said end; each of said tab or tabs extending from said end of said sidewall in a direction perpendicular to that sidewall and away from the other sidewall;

each of said tab or tabs defining one edge of a first slot between said end of said sidewall and said tab, said first slot extending upwardly from the lowermost portion of said tab to said point along said upper length along which said tab is joined to said end;

a downwardly extending second slot disposed in said first sidewall of said runner, said second slot having an outwardly widened upper portion and having a narrowed portion, said narrowed portion being of such width as to firmly but slidingly accommodate said sidewall or sidewalls of said second channel member which are provided with said tab or tabs;

said second slot being sufficiently narrow at all points so that when said sidewall or sidewalls of said second channel member which are provided with said tab or tabs are inserted into said second slot, the open area defined by said second slot is entirely overlapped by the combined areas of said tab or tabs and the space between said third and fourth sidewalls.

2. The improved assembly of claim 1, and in which each of said third and fourth sidewalls of said channel member has one of said tabs joined to its end, and in which said second slot firmly but slidingly accommodates both of said third and said fourth sidewalls.

3. The improved assembly of claim 1, and in which only said third sidewall of said channel member has a said tab joined to its end, and in which said second slot firmly but slidingly accommodates said third sidewall.

4. The improved assembly of claim 2, and in which each of said tabs is bent upwardly at its bottom at an angle sufficiently large to permit said tabs to be easily slid behind said first sidewall adjacent to said second slot.

5. The improved assembly of claim 3, and in which said tab is bent upwardly at its bottom at an angle sufficiently large to permit said tab to be easily slid behind said first sidewall adjacent to said second slot.

6. The improved assembly of claim 2, and in which said narrowed portion of said second slot comprises opposed vertical edges in the lower portion of said second slot.

7. The improved assembly of claim 3, and in which said narrowed portion of said second slot comprises opposed vertical edges in the lower portion of said second slot.

8. The improved assembly of claim 4, and in which said narrowed portion of said second slot comprises opposed vertical edges in the lower portion of said second slot.

9. The improved assembly of claim 5, and in which said narrowed portion of said second slot comprises opposed vertical edges in the lower portion of said second slot.

* * * * *